US008414310B2

(12) United States Patent
Zhu

(10) Patent No.: US 8,414,310 B2
(45) Date of Patent: Apr. 9, 2013

(54) ELECTRICAL CONNECTOR ASSEMBLY WITH CONTACTS EMBEDDED IN INNER BOTTOM OF MATING CAVITY

(75) Inventor: Yu Zhu, shenzhen (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 34 days.

(21) Appl. No.: 13/108,010

(22) Filed: May 16, 2011

(65) Prior Publication Data

US 2012/0122332 A1 May 17, 2012

(30) Foreign Application Priority Data

Nov. 16, 2010 (CN) ..... 2010 2 0608835

(51) Int. Cl.
*H01R 12/00* (2006.01)

(52) U.S. Cl.
USPC ..... 439/74

(58) Field of Classification Search ..... 439/74, 439/55, 570, 566, 626, 660
See application file for complete search history.

(56) References Cited

U.S. PATENT DOCUMENTS

| | | | | |
|---|---|---|---|---|
| 5,123,852 | A * | 6/1992 | Gillett | 439/67 |
| 5,133,667 | A * | 7/1992 | Daughtrey | 439/67 |
| 5,378,161 | A * | 1/1995 | Loder | 439/77 |
| 6,645,005 | B2 * | 11/2003 | Wu | 439/563 |
| 6,875,027 | B2 * | 4/2005 | Ye et al. | 439/74 |
| 6,881,085 | B2 * | 4/2005 | Yahiro et al. | 439/326 |
| 7,410,364 | B2 * | 8/2008 | Kishi et al. | 439/74 |
| 7,985,099 | B2 * | 7/2011 | Wu | 439/626 |
| 2004/0157478 | A1 * | 8/2004 | Midorikawa et al. | 439/74 |
| 2007/0141867 | A1 * | 6/2007 | Kishi et al. | 439/74 |
| 2008/0038939 | A1 * | 2/2008 | Wu et al. | 439/55 |
| 2009/0176386 | A1 * | 7/2009 | Wu | 439/74 |
| 2009/0286428 | A1 * | 11/2009 | Wu et al. | 439/752.5 |
| 2010/0068900 | A1 * | 3/2010 | Wu et al. | 439/74 |

* cited by examiner

*Primary Examiner* — Alexander Gilman
(74) *Attorney, Agent, or Firm* — Wei Te Chung; Ming Chieh Chang

(57) ABSTRACT

A connector assembly includes a receptacle and a plug. The receptacle includes a receptacle housing and a plurality of receptacle contacts received in the housing. The housing includes a mating cavity and a mating face defined on an inner bottom of the mating cavity. Each receptacle contact includes a plate contacting section embedded on the mating face. The plug includes a plug housing inserted in the mating cavity of the receptacle and a plurality of plug contacts received in the plug housing. The housing includes a mating face confronting with mating face of the receptacle. Each plug contact includes an elastic contacting section projecting beyond the mating face of the plug to touch with the receptacle contact.

20 Claims, 4 Drawing Sheets

ELECTRICAL CONNECTOR ASSEMBLY WITH CONTACTS EMBEDDED IN INNER BOTTOM OF MATING CAVITY

BACKGROUND OF THE INVENTION

1. Field of the Invention

The present invention relates generally to an electrical connector.

2. Description of Related Arts

Conventionally, a board-to-board connector assembly includes a plug connector mounted on a lower surface of a printed circuit board fitted into a receptacle connector mounted on an upper surface of another printed circuit board to electrically connect the two printed circuit boards. For example, U.S. Pat. No. 6,875,027 issued on Apr. 5, 2005 to Ye et al. discloses a board-to-board connector assembly which includes a plug connector and a receptacle connector mating with each other. The plug connector has a plurality of plug contacts arranged along the outer faces of a tongue mating portion thereof and the receptacle connector has a plurality of receptacle contacts arranged along the inner faces of a tongue receiving cavity thereof. Each receptacle contact extends along the mating direction and a corresponding plug contact frictionally touches the receptacle contact to achieve reliable depth therebetween. Because of the side-located contact, the contacts of plug are in danger of collapse during mating process. In addition, it is not easy for a regular rectangle block to guide the plug into the receptacle in a wide range of deviations in this small form connector.

Hence, an improved connector assembly is required to overcome the problems of the prior art.

SUMMARY OF THE INVENTION

Accordingly, an object of the present invention is to provide a connector assembly with contacts embedded in inner bottom of mating cavity.

To achieve the above object, a connector assembly includes a receptacle and a plug. The receptacle includes a receptacle housing and a plurality of receptacle contacts received in the housing. The housing includes a mating cavity and a mating face defined on an inner bottom of the mating cavity. Each receptacle contact includes a plate contacting section embedded on the mating face. The plug includes a plug housing inserted in the mating cavity of the receptacle and a plurality of plug contacts received in the plug housing. The housing includes a mating face confronting with mating face of the receptacle. Each plug contact includes an elastic contacting section projecting beyond the mating face of the plug to touch with the receptacle contact.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-4, an electrical connector assembly 100 of the present invention, used for connecting with two parallel circuit boards (not shown), includes a plug connector 1 and a receptacle connector 2.

Figure 4:
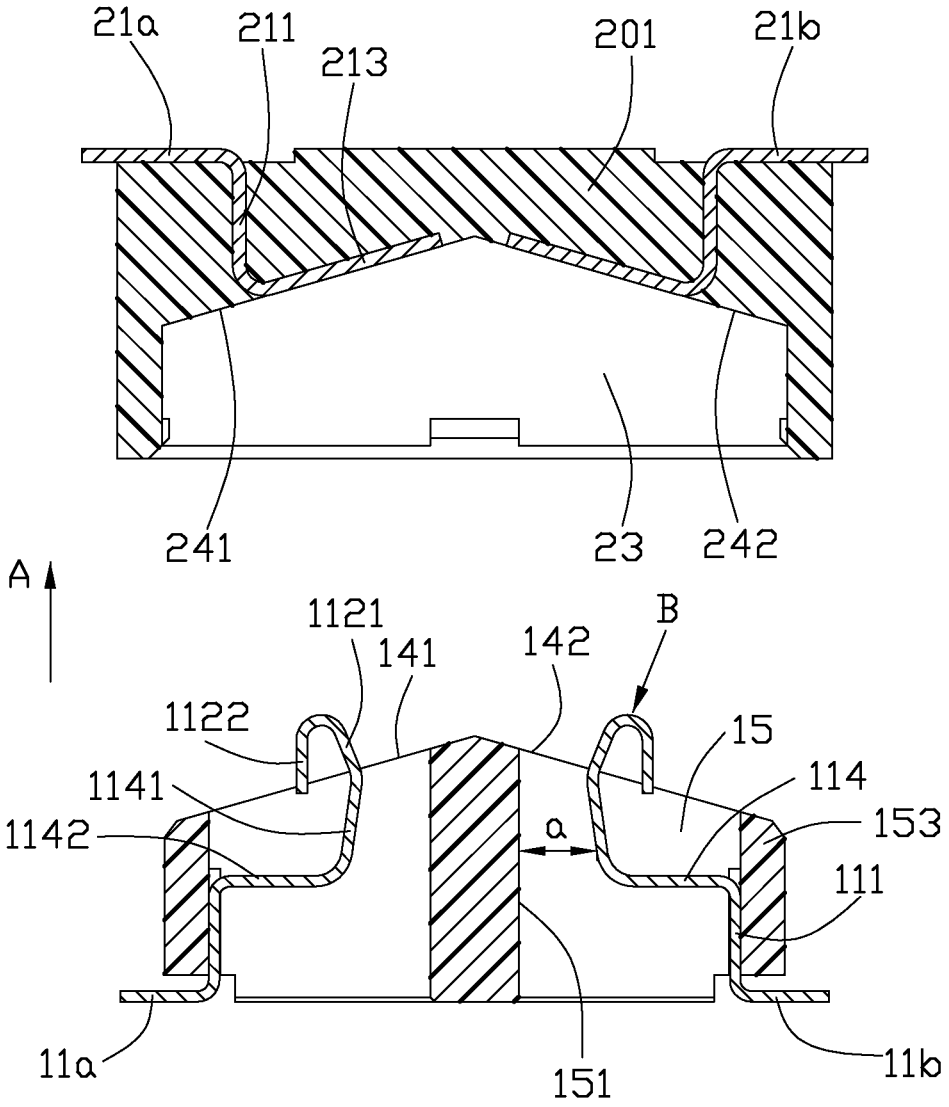
FIG. 4 is a cross section view of the electrical connector assembly taken along a broken line 4-4 in FIG. 1.

The plug connector 1 comprises a rectangular plug housing 10 and two rows of plug contacts 11 arranged along a direction of a long side of the rectangular plug housing. The plug housing 10 comprises a mounting face 12 and a mating face 14 opposite to the mounting face. A number of contact passageways 15 run through the mounting face 12 and the mating face 14 to retain the plug contacts 11. Each plug contact 11 comprises a retaining section 111, a hook-shaped contacting section 112, a mounting section 113 and an L-shaped joining section 114. FIG. 4 clearly shows that each retaining section 111 is retained in a first inner side 153 of the passageway 15. The joining section 114 extends horizontally from a top end of the retaining section 111 toward the second inner side 151 facing to the first inner side of the passageway and then bends to the mating face 14. The contacting section 112 extends from a free end of the joining section 114 and elastically protrudes out of the mating face 141. The mounting section 113 extends perpendicular to the retaining section 111 and parallel to the mounting face 12 of the housing and has a free end extending out of the a long outer side 13 of the rectangular housing.

The mating face 14 is configured to be a Λ-shaped convex formed by symmetrically inclined first surface 141 and second surface 142. Two rows of contacts 11*a*, 11*b* and passageways are symmetrically located on the two surfaces 141, 142. The joining section 114 comprises a horizontal part 1142 and a vertical part 1141 and the contacting section 112 comprises a first part 1121 extending from a top end of the vertical part 1141 beyond the mating face 14 and a second part 1122 folded back toward the mounting face. The top end of the vertical part 1141 (junction of the vertical part 1141 and the mating section) is generally located on or above the first surface 141 while a free end of the second part 1122 downwards extends below the first surface 141 to be received in the passageways. A certain distance a is defined between the vertical part 1141 and second inner side 151 to accommodate the deformed contacting section 112 because of the Λ-shaped mating face.

The receptacle connector 2 comprises a rectangular housing 20 and a plurality of receptacle contacts 21 received in the housing. The housing includes a mounting face 22 and a mating cavity 23 recessed from an opposite surface of the mounting face. A mating face 24 is defined on an inner bottom face of the mating cavity 23 and is opposite to the mounting face 22. The receptacle contacts 21 are in a plate type and are insert-molded between the mounting face 22 and the mating face 24 of the housing. Each receptacle contact 21 comprises a retaining section 211, a plate contacting section 213 extended from a top end of the retaining section 211 and embedded in a bottom wall 201 of the insulative housing. The retaining section is vertically retained on the bottom wall of the housing. The mounting sections 212 extend in a same plane of the mounting face 22. The contacting sections 213 are parallelly located on the mating face and exposing to the mating cavity 23.

The mating face 24 of the receptacle connector is configured to be a V-shaped concave for matching with the Λ-shaped convex of the plug connector. The concave is formed by symmetrically inclined third surface 241 and forth surface 242. Two rows of contacts 21*a*, 21*b* are symmetrically located on the two surfaces 241, 242. The retaining section 211 is perpendicular to the mounting face 22 and the plate contacting section 213 extends along an incline angle of the surface.

Figure 1:
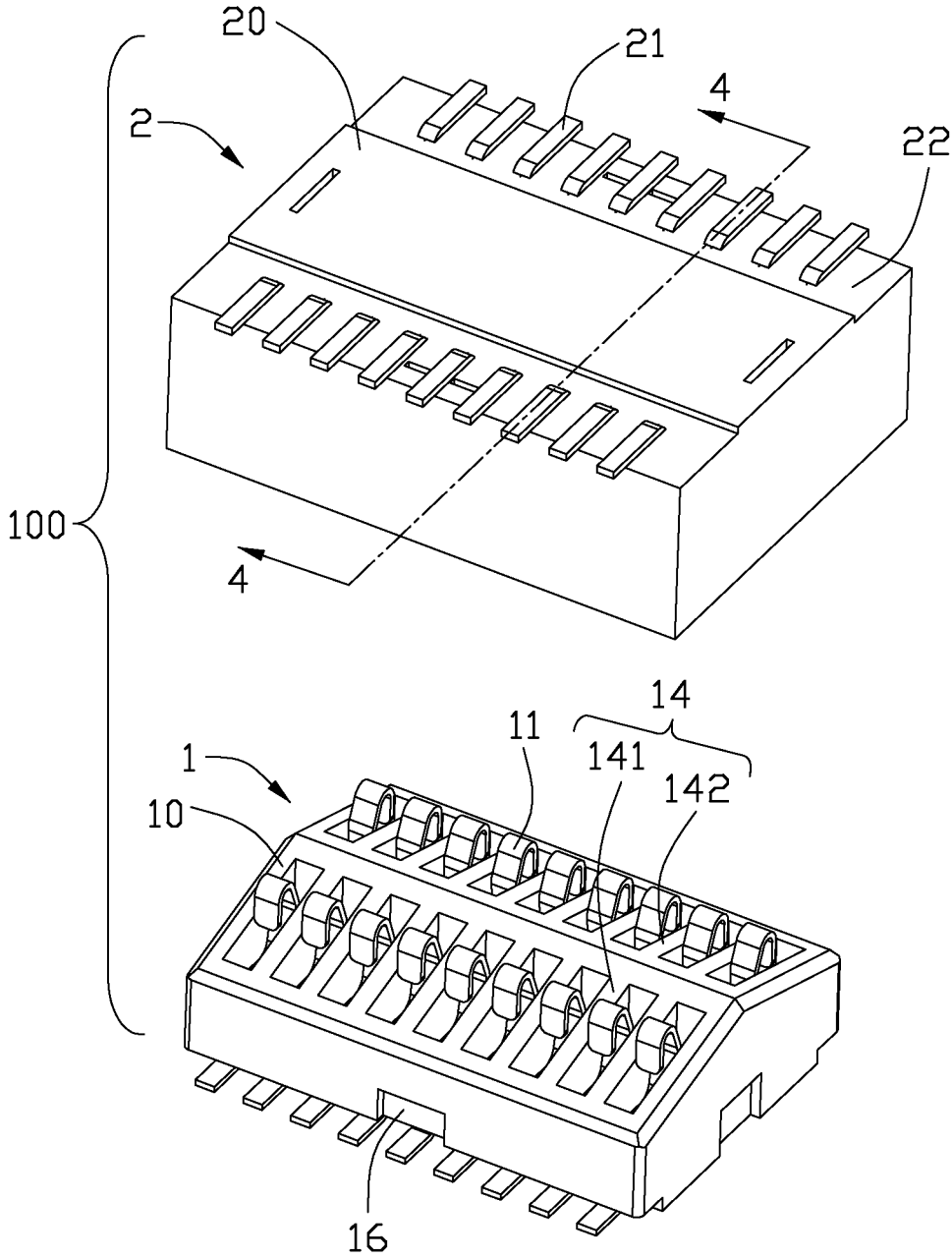
FIG. 1 is a perspective view of an electrical connector assembly in accordance with the present invention.
Figure 2:
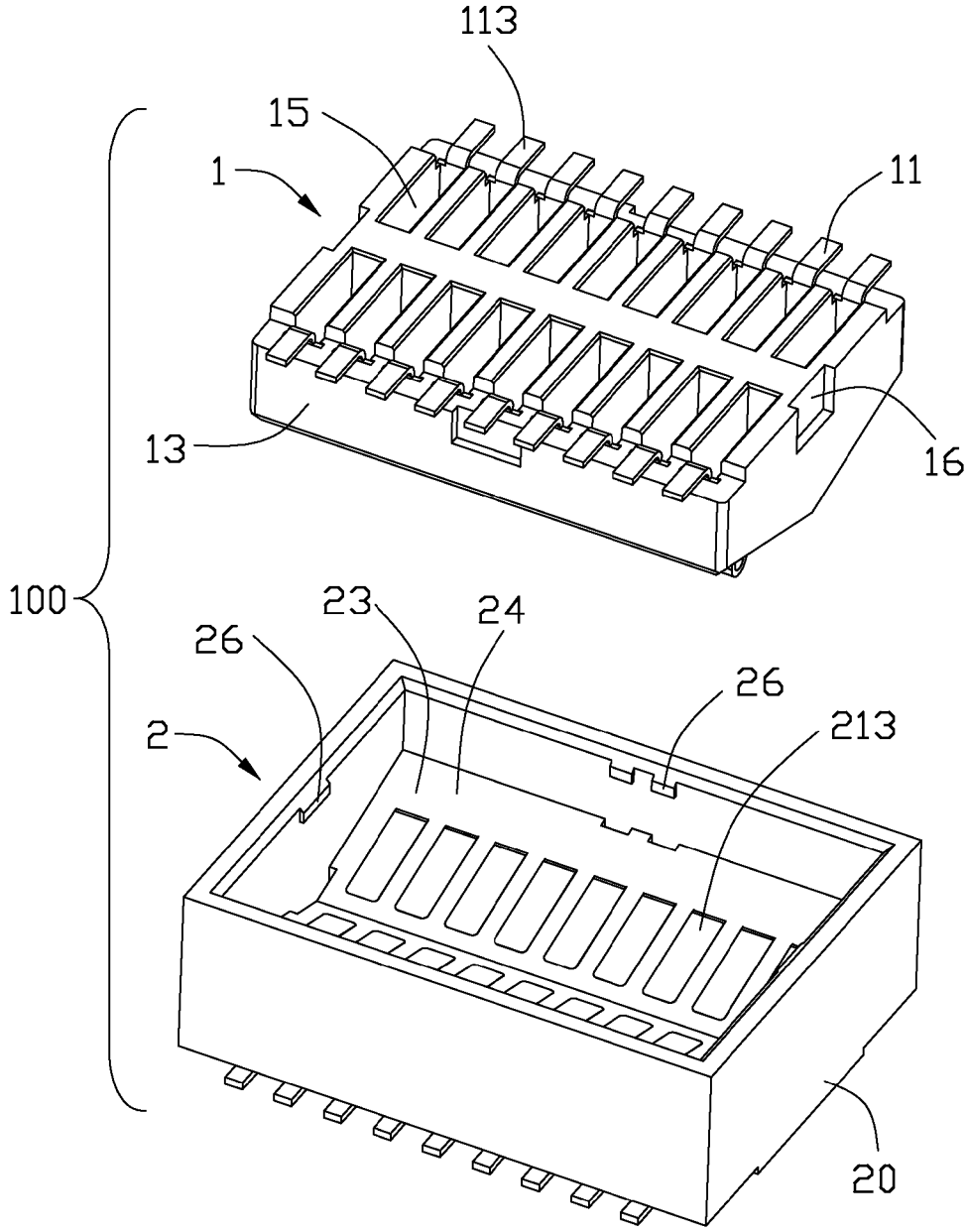
FIG. 2 is another perspective view of the electrical connector assembly of FIG. 1.
Figure 3:
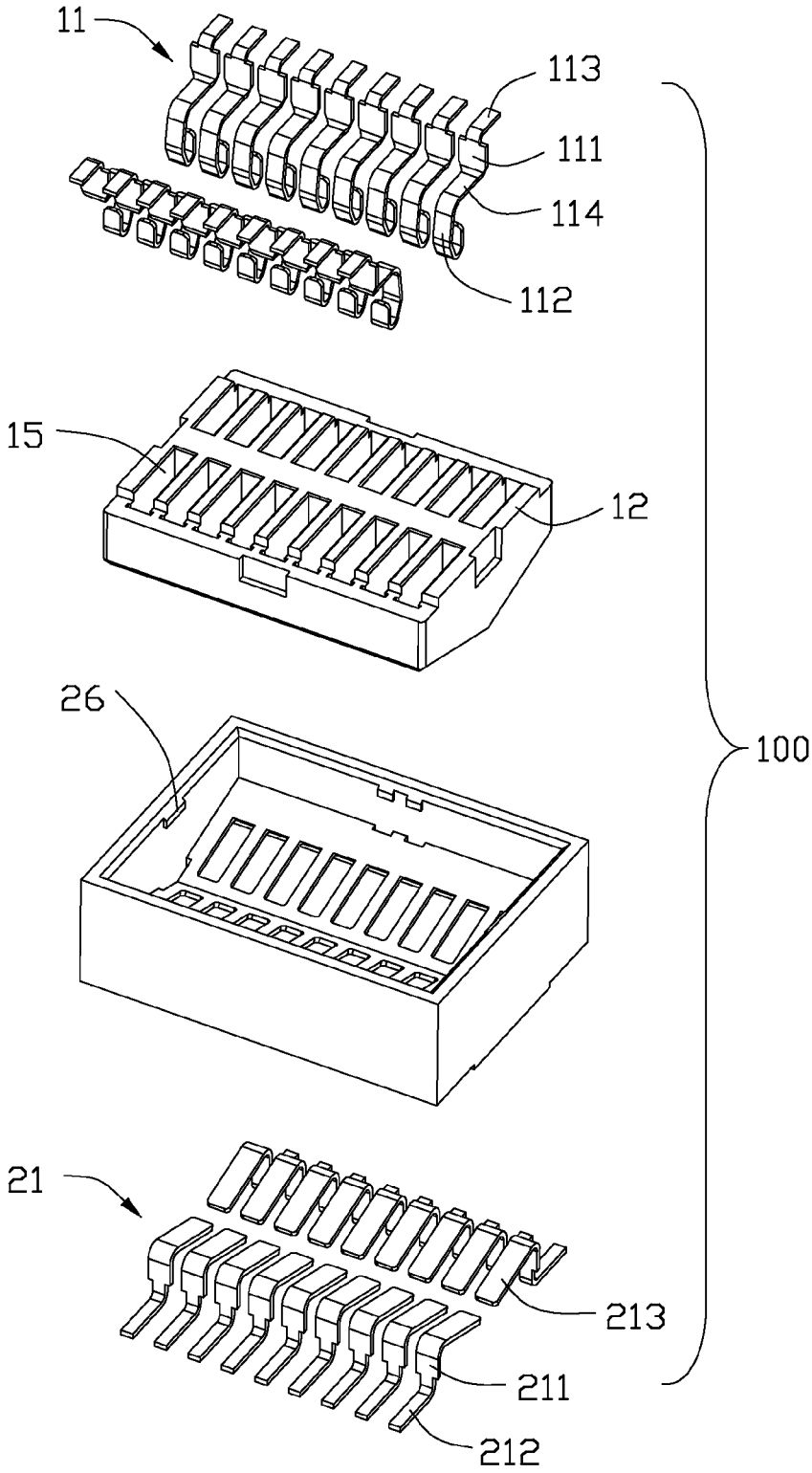
FIG. 3 is a perspective, exploded view of the electrical connector assembly.

Referring to FIGS. 1 & 2, a latching recess 16 is formed on each of the long and short side of the plug housing 10 to engage with corresponding latching protrusion 26 formed on the inner sides of the mating cavity of the receptacle housing 20.

In this prefer embodiment, the plug connector is inserted in the mating cavity 23 along an insert direction A, wherein the elastic contacting sections 112 of the plug press against the plate contacting sections 213 of the receptacle thereby the elastic contacting sections 112 deflect inwards in the passageways and slant to the second side 151 at the same time. Please pay high attention to the contacting sections 112 in FIG. 4, the first parts 1121 are bended perpendicularly to corresponding mating faces 14, 24 to ensure a movement of the contacting section 112 promoted by the mating faces is in an inward forced direction B. The force in the direction B decomposes to a vertical fore which provides engagement of said two contacting section 112,213 and a horizontal force to benefit engagement of said two housing. When complete mating of said two connectors, the elastic contacting sections 112 are generally depressed into the passageways, leaving contacting points to make electrical connection with the plate contacting sections of the receptacle. The inclined mating faces 141,142, 241,241 guide the plug connector into the receptacle in a wide range of deviations and make the plug contact deflect to the second side 151 easily.

In other embodiment, if the latching portions are enough to provide engaged force between said two housings, the mating faces of the plug connector and the receptacle can be defined with a one-piece plane shape, the contacting sections of the plug connector is parallel to the mounting face thereof and the contacting sections of the receptacle connector is perpendicular to the mounting face thereof.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A connector assembly comprising:

a receptacle connector comprising an insulative housing and a plurality of contacts received in the housing, the housing including a mounting face and a mating cavity, a mating face being defined on an inner bottom of the mating cavity and opposite to the mounting face of the receptacle connector;

each of the contacts of the receptacle comprising an engaging section fixed in the insulative housing, a plate contacting section embedded on the mating face and exposing to the mating cavity and a mounting section located on the mounting face of the insulative housing;

a plug connector comprising an insulative housing inserted in the mating cavity of the receptacle and a plurality of contacts received in the housing and touching with the contacts of the receptacle connector, the housing including a mating face confronting with mating face of the receptacle connector and a mounting face opposite to the mating face of the plug connector;

each of the contacts of the plug connector integrally comprising an elastic contacting section projecting beyond the mating face and a mounting section located on the mounting face of the plug connector;

wherein the housing of the plug connector defines several passageways running through both the mounting and mating faces to receive the contacts.

2. The connector assembly as claimed in claim 1, wherein the mating face of the plug connector is configured to be a Λ-shaped convex formed by inclined first and second surface, the mating face of the receptacle is configured to be a V-shaped concave corresponding to the convex of the plug connector.

3. The connector assembly as claimed in claim 2, wherein the first surface of the plug connector is assembled with a first row of plug contacts and the second surface is assembled with a second row of plug contacts, the first and second row set symmetrically.

4. The connector assembly as claimed in claim 3, wherein a latching protrusion is formed on an inner wall of the mating cavity of the receptacle housing and a corresponding latching recess is formed on the plug housing to hold the plug and receptacle connector together.

5. The connector assembly as claimed in claim 3, wherein angle between the first and second surface to an exterior is obtuse angle.

6. The connector assembly as claimed in claim 4, wherein the receptacle contacts are insert-molded between the mounting face and the mating face, each receptacle contact further comprises a retaining section vertically retained on a bottom wall of the housing and a mounting section located on the mounting face, the contacting section embeds on the mating face and exposes to the mating cavity.

7. An electrical connector comprising:

an insulative housing defining a mounting face, a mating face opposite to the mounting face and a number of passageways running through the mounting face and the mating face;

a plurality of contacts received in the passageways, each contact comprising a retaining section fixed in a first inner side of the passageway, a contacting section projecting above the mating face, a joining section integrally connecting with contacting section and the retaining section, and a mounting section located on the mounting face;

wherein the joining section of each contact separates from a second inner side opposite to the first inner side of the passageways;

wherein the contacting section is protruding from the mating face.

8. The electrical connector as claimed in claim 7, wherein the contacting section bends in a direction away the second inner side.

9. Each contacting section has a first part perpendicularly to the mating face and a second part folded back toward the mounting face.

10. The electrical connector as claimed in claim 9, wherein the mating face is configured to be a Λ-shaped convex formed by an inclined first and second surface.

11. The electrical connector as claimed in claim 10, wherein the joining section comprises a horizontal part extending horizontally from a top end of the retaining section and facing to the second inner side of the passageway and a vertical part bending towards the mating face, the first part of the mating section is formed from a free end of the vertical part.

12. An electrical connector assembly comprising:

a receptacle connector including:

an elongated insulative housing along a lengthwise direction and defining a mating cavity communicating with an exterior in a vertical direction, which is perpendicular to said lengthwise direction, via an opening and equipped with in said mating cavity a mating face which lies in an oblique plane defined by said lengthwise direction and an oblique direction which is oblique to said vertical direction while is perpendicular to said lengthwise direction; and a plurality of receptacle contacts disposed in the housing along said lengthwise direction, each of said receptacle contacts defining a stationary mating section compliantly located upon the mating face for mating with a plug connector, and a mounting section for mounting to a printed circuit board; further including said plug which includes another insulative housing adapted to be partially received in the mating cavity, a plurality of plug contacts each defining a deflectable mating section to mate with the stationary mating section of the receptacle contact, and another mounting section for mounting to another printed circuit board; wherein during mating, a contact point of the stationary mating section of the receptacle contact with regard to the deflectable mating section of the plug contact varies along the mating face in said oblique direction and essentially away from said another mounting section of the plug contact in the vertical direction.

13. The electrical connector assembly as claimed in claim 12, wherein said another insulative housing of the plug defines another mating face extending in said oblique direction and confronting said mating face of the receptacle connector in a parallel relation therebetween, wherein said deflectable mating section of the plug contact protrudes beyond said another mating face of the plug connector toward the mating face of the receptacle connector.

14. The electrical connector assembly as claimed in claim 12, wherein during mating, said contact point of the stationary mating section of the receptacle contact varies away from the mounting section of the plug contact not only in the vertical direction but also in a transverse direction perpendicular to both said vertical direction and said lengthwise direction.

15. The electrical connector assembly as claimed in claim 12, wherein the deflectable mating section of the plug contact is cantilevered, and the contact point of the stationary mating section of the receptacle contact contacts a free end zone of said deflectable mating section of the plug contact for mating.

16. The electrical connector assembly as claimed in claim 15, wherein the mating face defines an near end closer to the opening than a far end, and each of the plug contacts defines a retention section between the corresponding deflectable contacting section and mounting section, and said retention section is closer to said near end than to the far end so as to facilitate deflection of the deflectable contacting section during mating.

17. The electrical connector assembly as claimed in claim 16, wherein each of the receptacle contact defines retention section between the corresponding stationary contacting section and mounting section under condition that the retention section of the receptacle contact is linked to the near end of the corresponding contacting section.

18. The electrical connector assembly as claimed in claim 12, wherein the housing of the receptacle connector further defines another mating face symmetrically arranged with the mating face along a centerline of the housing of the receptacle connector, and another plurality of receptacle contacts disposed in the housing in a symmetrical manner with said plurality of receptacle contacts.

19. The electrical connector assembly as claimed in claim 18, wherein said two mating faces commonly define a peak like structure in the mating cavity.

20. The electrical connector assembly as claimed in claim 19, wherein the plug contacts further includes another plurality of plug contacts symmetrically arranged with the plug contacts for mating with said another plurality of receptacle contacts.

* * * * *